US007874602B2

(12) United States Patent
Meckwood et al.

(10) Patent No.: US 7,874,602 B2
(45) Date of Patent: Jan. 25, 2011

(54) CARRYING APPARATUS

(75) Inventors: Kimberly Meckwood, Los Angeles, CA (US); Audrey Liu, Pasadena, CA (US)

(73) Assignee: Click & Carry, Inc., Los Angeles, CA (US)

( * ) Notice: Subject to any disclaimer, the term of this patent is extended or adjusted under 35 U.S.C. 154(b) by 313 days.

(21) Appl. No.: 12/057,188

(22) Filed: Mar. 27, 2008

(65) Prior Publication Data

US 2009/0242596 A1 Oct. 1, 2009

(51) Int. Cl.
*A45F 5/00* (2006.01)

(52) U.S. Cl. ..... 294/137; 294/158

(58) Field of Classification Search ..... 294/137, 294/145, 171, 146, 159, 158
See application file for complete search history.

(56) References Cited

U.S. PATENT DOCUMENTS 2,676,836 A * 4/1954 Raphael ..... 294/87.24
6,694,574 B1 * 2/2004 Sheng ..... 24/265 H
7,125,061 B1 * 10/2006 Hajianpour ..... 294/159
2008/0276430 A1 * 11/2008 Sharpe ..... 16/430
2009/0206621 A1 * 8/2009 Payne ..... 294/158

* cited by examiner

*Primary Examiner*—Paul T Chin
(74) *Attorney, Agent, or Firm*—F. Jason Far-hadian, Esq.; Century IP Group

(57) ABSTRACT

An apparatus, in accordance with one embodiment comprises an upper portion; a lower portion comprising at least one terminal end having a receiving area formed on a first side of the lower portion, facing the upper portion, on which at least a looped handle may rest and a handling area formed on a second side of the lower portion opposite the first side forming a grip to lift the apparatus; and a connection mechanism for connecting the upper portion and the lower portion, wherein the connection mechanism allows the upper portion to swivel in relation to the lower portion, such that in an open position the looped handle may be placed on the receiving area, and in a closed position the upper portion swivels to cover the terminal end of the lower portion and the receiving area in a closed loop to secure the looped handle, eliminating possibility of the looped handle sliding off the receiving area and the terminal end of the lower portion.

11 Claims, 6 Drawing Sheets

Carrying Apparatus: USE swivel open & loop bags in

Carrying Apparatus

Carrying Apparatus side view top view

Carrying Apparatus: PARTS

Carrying Apparatus: PARTS

Carrying Apparatus: USE swivel open & loop bags in swivel closed and carry side view

Carrying Apparatus: USE

CARRYING APPARATUS

TECHNICAL FIELD

The present disclosure relates generally to carrying apparatuses and more particularly to a carrying apparatus designed for use in connection with looped handles, to provide for convenient and comfortable transportation of multiple items such as shopping bags, umbrellas, handbags, etc. The apparatus may also include advertising space, such that it may be given away as a promotional item by a supermarket or other business.

BACKGROUND

The transport of multiple shopping bags is generally difficult, especially over long distances. Shopping bags can be heavy and cumbersome to carry. For example, the bags can bump into one another and into the person carrying them, causing injury or discomfort.

To avoid this difficulty and discomfort, individuals are often forced to make multiple trips when transporting shopping bags from place to place, such as from one's car to one's home. By making multiple trips, the individual can avoid the discomfort of transporting multiple shopping bags by hand, but only after expending considerable time and effort.

A person might also be unable to carry as many shopping bags as they would like if they are traveling long distances, such as from the store to their home via public transportation. Fatigue or pain also typically result from carrying a heavy load over a long distance, using the standard looped handles of the shopping bags.

It would be advantageous if one could easily carry multiple shopping bags or other items without having to endure the above-noted discomfort.

DETAILED DESCRIPTION OF EXAMPLE EMBODIMENTS

Figure 1:
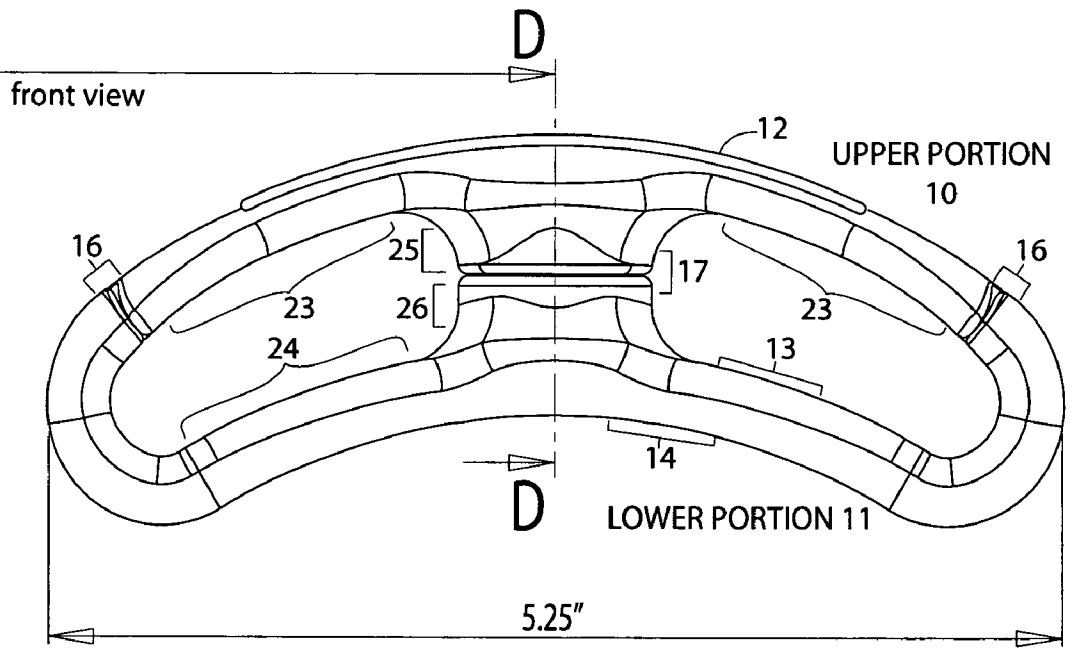
FIG. 1 is a front view of a carrying apparatus, in accordance with one embodiment.
Figure 2:
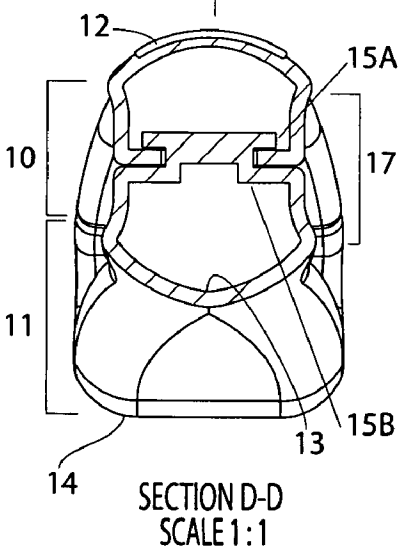
FIG. 2 is a cross-sectional view of the carrying apparatus taken at cross-section D-D of FIG. 1.
Figure 3:
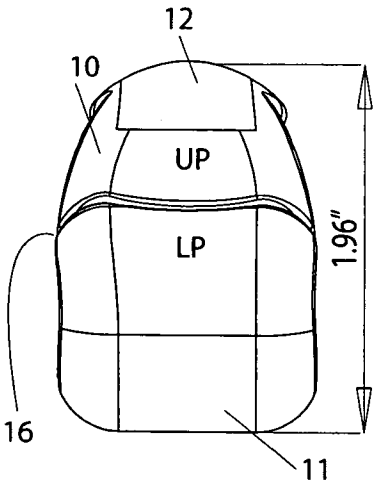
FIG. 3 is a side view of the carrying apparatus of FIG. 1.
Figure 4:
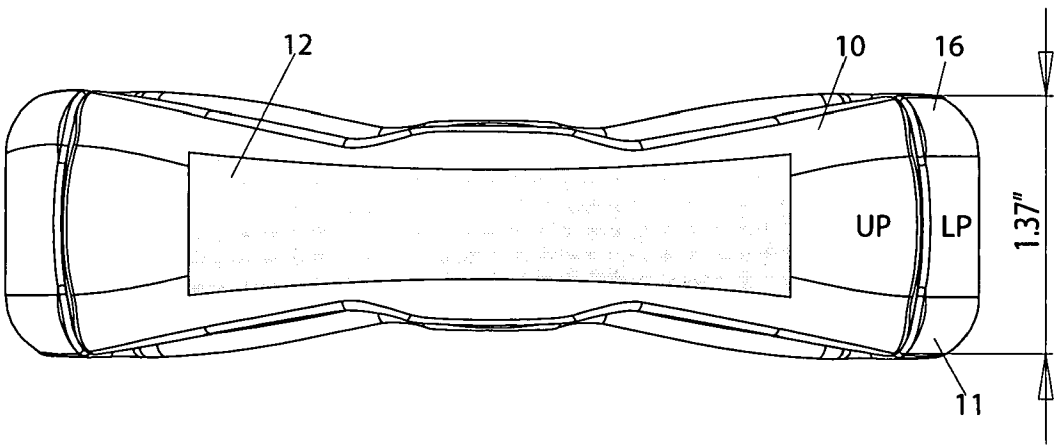
FIG. 4 is a top view of the carrying apparatus of FIG. 1.

A carrying apparatus for convenient and comfortable transportation of multiple shopping bags or other items is illustrated in FIG. 1. In one embodiment, the carrying apparatus comprises an upper portion 10, and a lower portion 11. The lower portion may comprise at least one terminal end having a receiving area 13 formed on a first side of the lower portion 11, facing the upper portion 10, on which at least a looped handle 20 may rest. A handling area 14 may be formed on a second side of the lower portion 11 opposite the first side forming a grip, for example, for a person to lift the apparatus. A connection mechanism 17 allows the upper portion 10 to connect to and swivel in relation to the lower portion 11, such that in an open position a looped handle 20 (of a bag, for example, as shown in FIG. 3) may be placed on the receiving area 13.

In a closed position, the upper portion 10 swivels to cover the terminal end of the lower portion 11 and the receiving area 13 in a closed loop to secure the looped handle 20. The closed loop construction eliminates the possibility of the looped handle 20 sliding off the receiving area 13 and the terminal end of the lower portion 11. In one embodiment, the upper portion 10 comprises an upper neck 25 and two arms 23. The arms 23 extend outward from the center of the upper portion 10 where upper neck 25 is positioned. Each of the arms 23 comprises a proximate end near the upper neck 25 and a distal end furthest from the upper neck 25. In the exemplary embodiment illustrated in FIG. 1, the arms 23 gently slope toward the lower portion 11 as they extend away from the upper neck 25 of the apparatus.

The lower portion 11 comprises a lower neck 26 and two arms 24. In one embodiment, the arms 24 may slope away from the upper portion 10 and then curve in a sharp angle preferably in the opposite direction toward the upper portion 10. The arms 24 are curved in a manner such that the arms 23 and the arms 24 touch at distal connection points 16, forming two closed loops on each side of upper neck 25 and lower neck 26.

Figure 5:
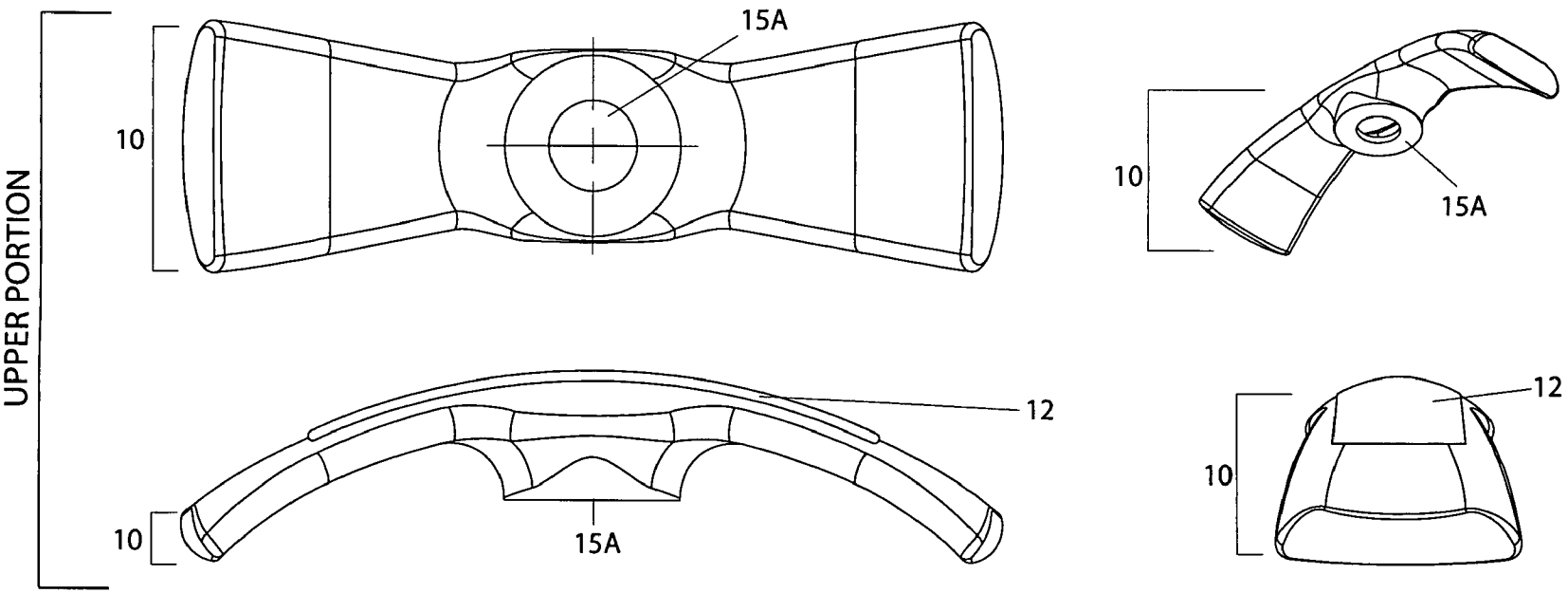
FIG. 5 is an exploded view of the upper portion of the carrying apparatus from multiple angles, in accordance with one embodiment.
Figure 6:
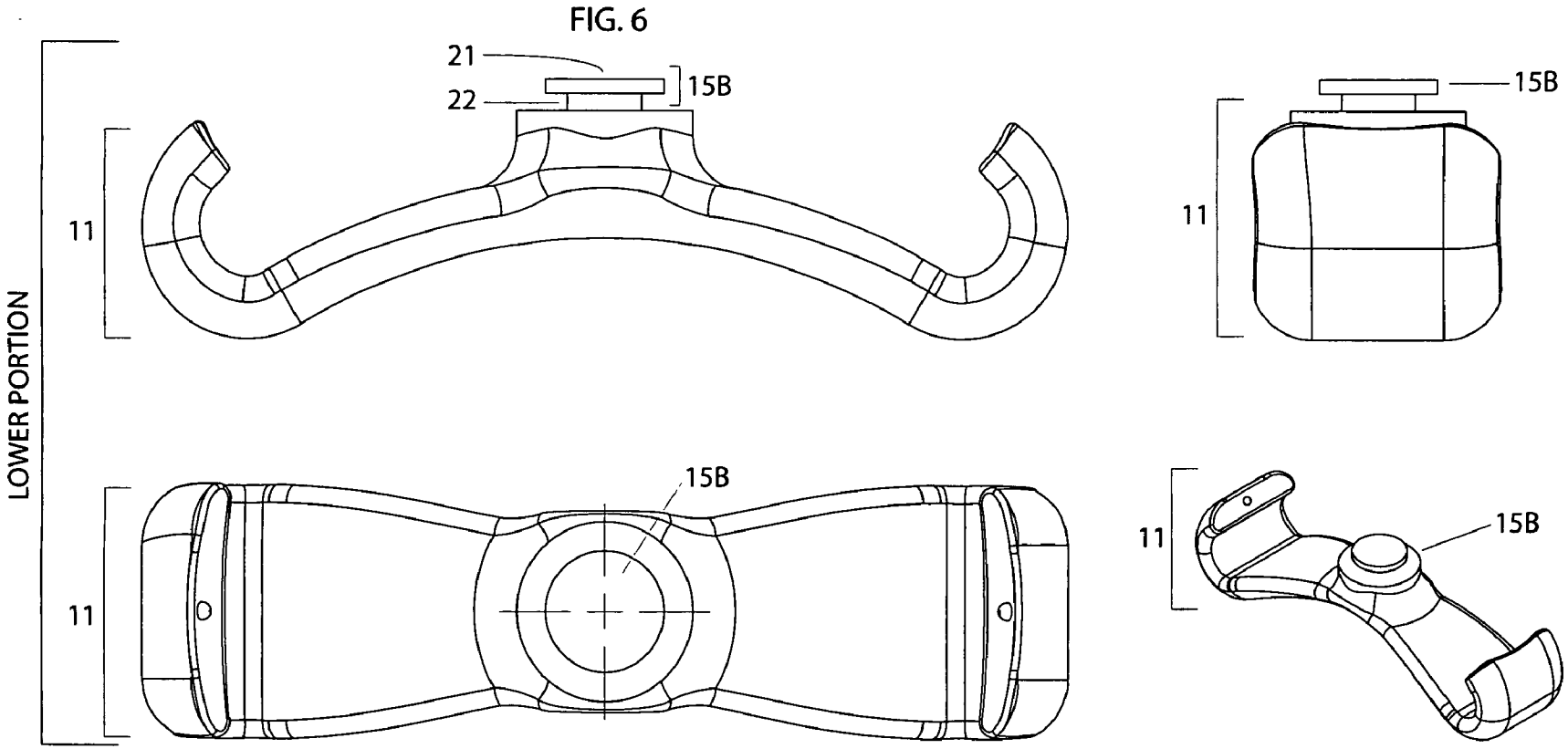
FIG. 6 is an exploded view of the lower portion of the carrying apparatus from multiple angles, in accordance with one embodiment.

As noted, the lower portion has a receiving area 13 and a handling area 14, and the upper portion 10 and the lower portion 11 are connected via a connection mechanism 17 which spans the distal ends of both the upper neck 25 and the lower neck 26 as shown in FIGS. 1-9. Referring to FIGS. 5 and 6, in one embodiment, the connection mechanism 17 may comprise a snap-fit construction with a receiving cavity 15A on the upper neck 25 and a complementary protruding area 15B on the lower neck 265 that allows the upper portion 10 to rotate over the lower portion 11, as provided in further detail below. In certain embodiments, instead of a snap-fit construction, a magnetic assembly may be utilized to construct the connection mechanism 17, with oppositely charged magnates fixed to upper neck 25 and lower neck 26 each.

Figure 7:
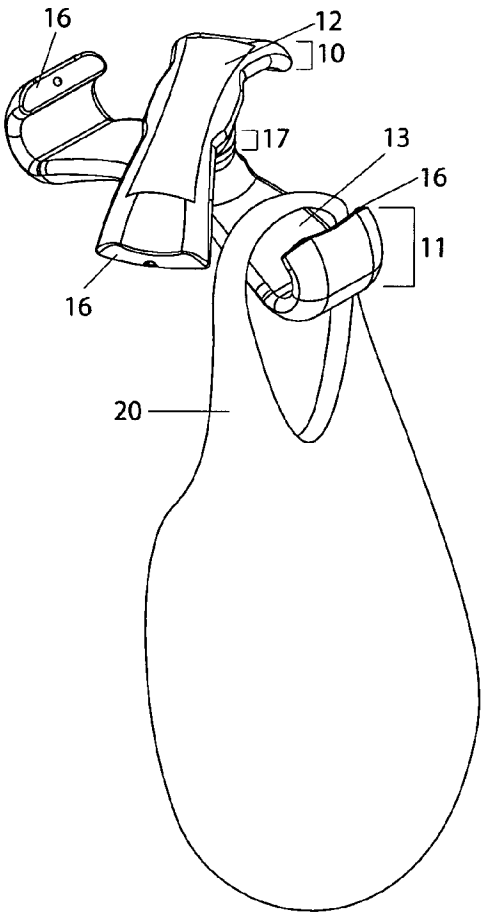
FIG. 7 is a view of the carrying apparatus in an open position, with a shopping bag engaging the lower portion, in accordance with one embodiment.

To use the carrying apparatus, a user may swivel the carrying apparatus to an open position. In one embodiment, swiveling of the apparatus to an open position involves rotating the upper portion 10 in relation to the lower portion 11 about a swivel axis of connection mechanism 17, as is illustrated in FIG. 7. Note that in this embodiment, when the apparatus is in an open position, the arms 23 and the arms 24 are not touching at the outer connection points 16, as the upper neck 25 and the lower neck 26 remain connected via the connection mechanism 17. The user may then place the desired looped handles 20 of one or more carrying items onto the receiving area 13 of the lower portion 11.

Figure 8:
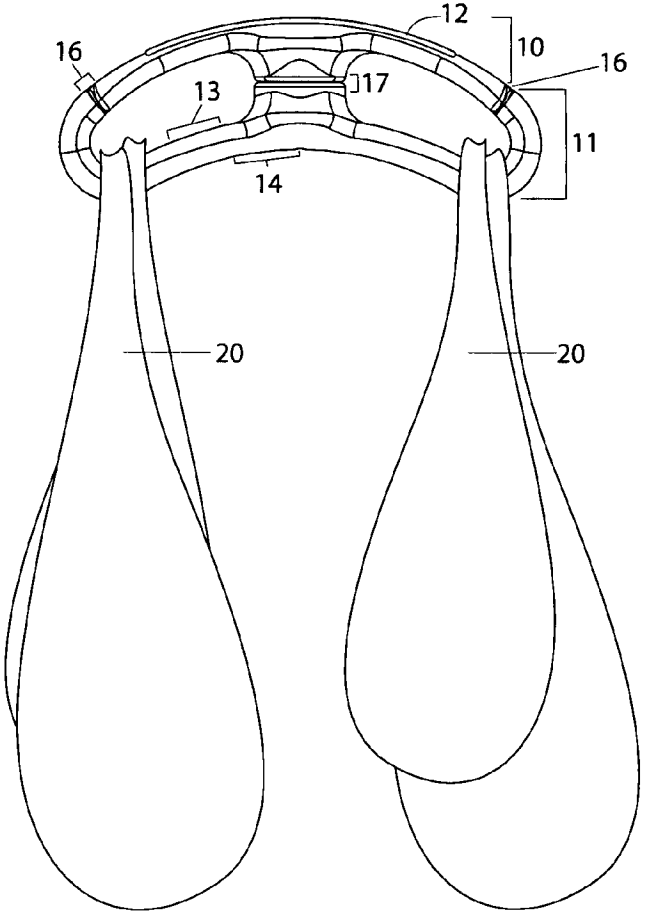
FIG. 8 is a front view of the carrying apparatus in a closed position, with several shopping bags engaging multiple hook positions, in accordance with one embodiment.
Figure 9:
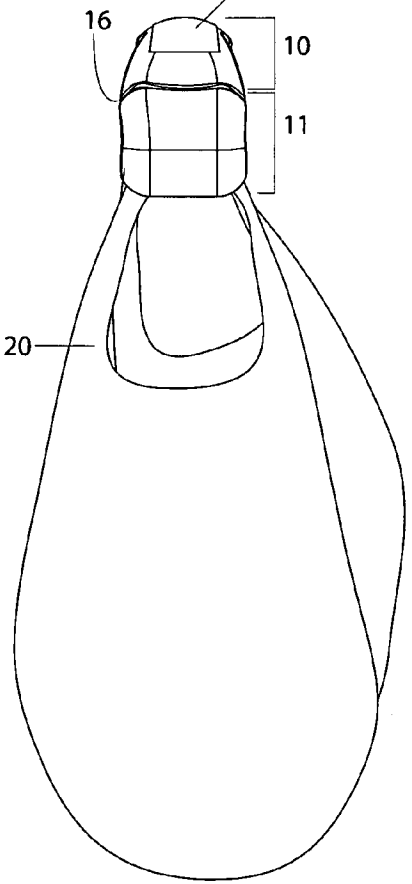
FIG. 9 is a side view of the carrying apparatus in a closed position, in accordance with one embodiment.

After placing the desired looped handles 20 onto the receiving area 13, the user may then swivel the carrying apparatus to a closed position to prevent the looped handles 20 from sliding off the receiving area 13. In one embodiment, swiveling the apparatus to a closed position involves rotating the upper portion 10 in relation to the lower portion 11 about a swivel axis of connection mechanism 17, as illustrated in FIGS. 8 and 9. Note that in this embodiment, when the apparatus is in a closed position, the arms 23 and 24 are touching at the distal connection points 16, while the upper neck 25 and the lower neck 26 are connected via the connection mechanism 17.

Depending on implementation, upper portion 10 and lower portion 11 may rotate about the central swivel axis of connection mechanism 17, for example from 0 to 360 degrees, either freely or in a step-lock fashion, due to designer grooves (not shown) carved into the surface portions of the upper neck 25 and lower neck 26 that face each other, to provide variable degrees of opening for the apparatus when it is in an open position. As such, the user of the carrying apparatus may have the option to adjust the opening angle for the carrying apparatus as is convenient or necessary to insert or remove the looped handles 20 of one or more carrying items.

The snap-fit construction in accordance with one embodiment is shown in greater detail in FIGS. 5 and 6. The receiving cavity 15A of the upper neck 25 is illustrated in FIG. 5. The complementary protruding area 15B of the lower neck 26 is illustrated in FIG. 6. In the illustrated embodiment, the protruding area 15B (i.e., the male portion) will snap and fit into a receiving cavity 15A (i.e., the female portion), such that the upper portion 10 and the lower portion 11 will be connected via the connection mechanism 17, while still allowing rotational movement between the upper portion 10 and the lower portion 11.

The snap-fit construction of the male and female portions are such that the male portion comprises a relatively elongated protruding area 15B having an end 22 proximate to the inner area of the lower neck 26 and a terminal end 21 that extends away from said proximate end 22. The width or diameter of the terminal end 21 about its elongated axis is sufficiently larger than that of the proximate end 22 and than that of the internal diameter of receiving cavity 15A, such that when the terminal end 21 engages the female portion in a snap-fit manner, the terminal end 21 of the male portion may not be easily removed from the receiving cavity 15A of the female portion.

In an alternative embodiment, the snap-fit construction is implemented so that the male portion may be removably attached to the female portion. That is, the width or diameter of the terminal end 21 about its elongated axis may be slightly larger than the internal diameter of the receiving cavity 15A to allow a user to insert or remove the male portion in or from the female portion without exertion of a substantial amount of force. In this manner, a user may also choose to carry the lower portion 11 independent of the companion upper portion 10. The lower portion 11 can be used in the same manner as disclosed above. Without the upper portion 10, however, a user may not be able to secure the looped handles 20 by placing the carrying apparatus in a closed position. Regardless, the lower portion 11 by itself does have utility for allowing a user to carry multiple items at the same time.

In accordance with another aspect, a comfortable grip on the handling area 14 may be provided for easing pressure on the hand or figures of a person using the apparatus. In one embodiment, the handling area 14 of the lower portion 11 comprises a gel-grip or other ergonomic design (e.g., gripping grooves, etc.) for comfortable handling. In certain embodiments, the handling area 14 is of a substantial width to allow distribution of pressure across a greater area of the user's hand and to reduce level of pressure on the user's grip. Distribution of the pressure alleviates the associated discomfort that can result from carrying heavy items that have thin carrying handles that cut or dig into a person's flesh.

An optional feature of the apparatus is to have it function as a promotional item for supermarkets or other businesses. In one embodiment, for example, the apparatus has a panel 12 on which an advertisement may be placed (See FIGS. 4 and 5 in particular). The panel 12 may be located on the upper portion 10 or other position on the apparatus that has high visibility to a user or others.

Desirably, the upper portion 10 and lower portion 11 are constructed of a molded plastic, optionally comprising an inner metal reinforcement, in accordance to one or more embodiments. The inner metal reinforcement may be in the form of a metal mesh or in the form of a single or a network of metal wires running through or embedded in a molded plastic body.

Depending on implementation and in alternative embodiments, the apparatus and its various components may be made from any material suitable for carrying out the functions and purposes disclosed above. Not all components need to be made from the same material, but never-the-less for the purpose of efficiency and cost control, the upper and lower portions 10 and 11 may each have a monolithic construction.

Some embodiments may be constructed from natural material such as wood, rubber, or various types of metals, or alternatively from artificially produced material such as epoxy resin, solidified plastic or other artificial byproducts of petroleum, or a combination of said material.

Accordingly, a carrying apparatus for convenient and comfortable transportation of multiple shopping bags or other items is disclosed. It should be understood that the invention can be practiced with modification and alteration within the spirit and scope of the appended claims. The description is not intended to be exhaustive or to limit the invention to the precise form disclosed. It should be understood that the invention can be practiced with modification and alteration and that the invention be limited only by the claims and the equivalents thereof.

What is claimed is:

1. An apparatus comprising, an upper portion;

a lower portion comprising at least one terminal end having a receiving area formed on a first side of the lower portion, facing the upper portion, on which at least a looped handle of one or more shopping bags may rest and a handling area formed on a second side of the lower portion opposite the first side forming a grip to lift the apparatus, wherein the handling area forming said grip has a substantially wide surface area to spread respective weight of said one or more shopping bags across fingers of a user lifting the one or more shopping bags engaged in the receiving area of the lower portion; and a connection mechanism for connecting the upper portion and the lower portion, wherein the connection mechanism allows the upper portion to swivel in relation to the lower portion, such that in an open position the looped handle may be placed on the receiving area, and in a closed position the upper portion swivels to cover the terminal end of the lower portion and the receiving area in a closed loop to secure the looped handle of the one or more shopping bags, eliminating possibility of the looped handle of the one or more shopping bags sliding off the receiving area and the terminal end of the lower portion, wherein the grip area is monolithic with respect to the lower portion and located below the connection mechanism that allows the upper portion to swivel in relation to the lower portion.

2. The apparatus of claim 1, wherein the connection mechanism has a snap-fit construction, for allowing the top portion to rotatably connect to the lower portion about a central axis.

3. The apparatus of claim 1, wherein the connection mechanism utilizes a multi-magnet construction, for allowing the upper portion to detachably connect to the lower portion.

4. The apparatus of claim 1, wherein the upper portion and lower portion are constructed of a molded plastic.

5. The apparatus of claim 1, wherein the upper portion and lower portion are constructed of a molded plastic comprising an inner metal reinforcement.

6. The apparatus of claim 1, wherein the handling area comprises of a gel-grip for comfortable handling.

7. The apparatus of claim 1, wherein the handling area is of a substantial width to distribute pressure across a greater area and reduce pressure on the grip.

8. The apparatus of claim 1, wherein the upper portion has an external side and an internal side facing the receiving area of the lower portion, wherein the upper portion is bent in a bow shape, such that the concave side of the upper portion faces the receiving area of the lower portion, and wherein the lower portion is bent in a bow shape, such that the convex side of the lower portion faces the concave side of the upper portion.

9. The apparatus of claim 8, wherein the upper portion is connected to the lower portion by way of the connection mechanism such that the connection mechanism connects center of the upper portion to center of the lower portion and wherein the upper portion and the lower portion are shaped such that width of the center cross sections of the upper portion and the lower portion is smaller than width of the terminal ends of the lower portion and the upper portion such that the upper portion and the lower portion are partially tapered inwardly toward their centers.

10. The apparatus of claim 9, wherein the upper portion and the lower portion, each have two opposing terminal ends, wherein locations where the terminal ends of the upper portion meet the terminal ends of the lower portion are formed to have male and female locking dimples, such that when the male and female locking dimples are aligned additional friction created between the male and female locking dimples prevents the upper portion to easily unlock from the lower portion.

11. The apparatus of claim 1, wherein the combination of the substantially wide surface area of the grip and the location of the grip area below the connection mechanism also allows a user to place the grip area on the user's shoulder for purpose of stably carrying heavy bags without using his hands.

* * * * *